United States Patent [19]

Perkins

[11] Patent Number: 4,462,223

[45] Date of Patent: Jul. 31, 1984

[54] METHOD AND MEANS FOR PREVENTING COUPLING FREEZING

[75] Inventor: Warren E. Perkins, Port St. Lucie, Fla.

[73] Assignee: CRYO$_2$ Corporation, Fort Pierce, Fla.

[21] Appl. No.: 479,495

[22] Filed: Mar. 28, 1983

[51] Int. Cl.[3] ..... F25B 39/02

[52] U.S. Cl. ..... 62/514 R; 62/55; 285/41; 285/DIG. 5; 403/23

[58] Field of Search ..... 62/55, 299, 514 R; 403/23; 285/41, DIG. 5; 220/88 B

[56] References Cited

U.S. PATENT DOCUMENTS

| | | | |
|---|---|---|---|
| 2,764,873 | 10/1956 | Mooyaart | 62/55 |
| 2,964,918 | 12/1960 | Hansen et al. | 62/55 |
| 3,488,067 | 1/1970 | Sommer | 285/41 |
| 4,168,921 | 9/1979 | Blanchard | 403/23 |

*Primary Examiner*—Ronald C. Capossela
*Attorney, Agent, or Firm*—Roland H. Shubert

[57] ABSTRACT

Freezing of ice on quick connect couplings during transfer of a cryogenic liquid, such as liquid oxygen, from one container to another is prevented by providing a cup-like shield means encircling the body of the coupling. Cold, dry purge gas from the container being filled is introduced into the shield base at a point remote from its open end while the cryogenic liquid is passing through the coupling.

28 Claims, 2 Drawing Figures

METHOD AND MEANS FOR PREVENTING COUPLING FREEZING

BACKGROUND OF THE INVENTION

This invention relates generally to a method and means for preventing freezing of the coupling valves during transfer of a cryogenic liquid from one vessel to another.

More specifically, this invention relates to means for preventing freezing of the quick disconnect coupling during charging of a portable liquid oxygen container from a stationary storage container in home oxygen therapy systems.

A number of commercially available systems have been developed to provide supplementary oxygen for persons of impaired breathing ability. Such systems typically comprise a relatively large capacity stationary container and a small portable container having a capacity sufficient to provide several hours use. The large stationary container typically is sized to hold sufficient liquid oxygen to provide one to two weeks of continuous oxygen therapy. It is used as the oxygen supply for in-home use and as a refill source for portable units.

Size and weight considerations govern the capacity of portable liquid oxygen therapy units. Such units usually are sized to provide about three to about fourteen hours of continuous oxygen supply; adequate for a person working normal hours and for shopping, visiting and other short trips. In preparation for use, the portable unit is filled with liquid oxygen from the stationary home unit. The stationary and portable units are equipped with mating, quick-connect couplings to allow refill of the portable unit and to allow periodic recharging of the home unit.

The quick-connect coupling comprises a male fitting, preferably associated with the portable unit, and a female fitting, preferably associated with the stationary unit. Both male and female fittings include a normally closed poppet valve which valves are locked into an open position when coupled in a mating posture. Filling of the portable unit is then accomplished by venting gas from the portable unit allowing liquid oxygen, under positive pressure in the stationary container, to flow through the coupling and fill the portable unit. The two units are then disconnected causing the spring loaded poppet valves in both male and female fittings to automatically close.

Liquid oxygen is extremely cold having a normal boiling point of about −297° F. Flow of liquid oxygen through the fill tubulation and quick-connect coupling condenses and freezes moisture from the air on the coupling and tubulation. This effect is most extreme in a humid environment and often results in an ice build-up on the coupling sufficiently thick and strong as to render uncoupling impossible.

The ice-locked coupling can be freed simply by leaving the two containers in a coupled position long enough for the ice to melt; typically some five to fifteen minutes. However, many users of liquid oxygen therapy systems do not sufficiently understand the cause and cure of this icing problem to cope with it. They often will attempt to force disengagement of the coupling, risking damage to one or the other of the units, or will consider the units to be broken requiring an unnecessary service call.

Besides causing inconvenience to the user, icing an cause damage to the quick-connect coupling itself. The female portion of the coupling is fitted with a resilient seal forming a press fit with the male portion to prevent leakage of liquid oxygen during filling. Ice in the coupling causes abrasive damage to the sealing gasket during the uncoupling procedure. This gasket damage then allows linkage of liquid oxygen during subsequent refilling operations.

The problems associated with condensation and freezing of moisture on couplings during the transfer of cryogenic fluids in general, and of liquid oxygen in particular, have long been recognized. Yet the art has failed to provide any effective means to avoid the icing of couplings of sufficiently uncomplicated nature as to allow its use on oxygen therapy systems.

SUMMARY OF THE INVENTION

Icing of a coupling due to condensation and freezing of atmospheric moisture thereon during the transfer of a cryogenic liquid from one container to another is prevented by providing shield means encircling the coupling and continuously flooding the interior of the shield means with a dry, cold gas during liquid transfer. The cold, dry gas is obtained as a vent stream from the container being filled. The invention is particularly advantageous for use with home liquid oxygen thereby systems of the type including a small portable unit and a larger stationary unit from which the portable unit is refilled.

Hence, it is an object of this invention to prevent freezing of coupling means during transfer of a cryogenic liquid there through.

It is a specific object of this invention to provide means for preventing freezing of quick connect couplings during transfer of a very cold, liquified gas from one container to another.

Another specific object of this invention is to provide a method and means for use with home liquid oxygen therapy systems to prevent freezing of the coupling when refilling portable oxygen units.

DESCRIPTION OF THE DRAWING

Specific embodiments of the invention are illustrated in the drawing in which.

DESCRIPTION AND DISCUSSION OF THE INVENTION

Figure 1:
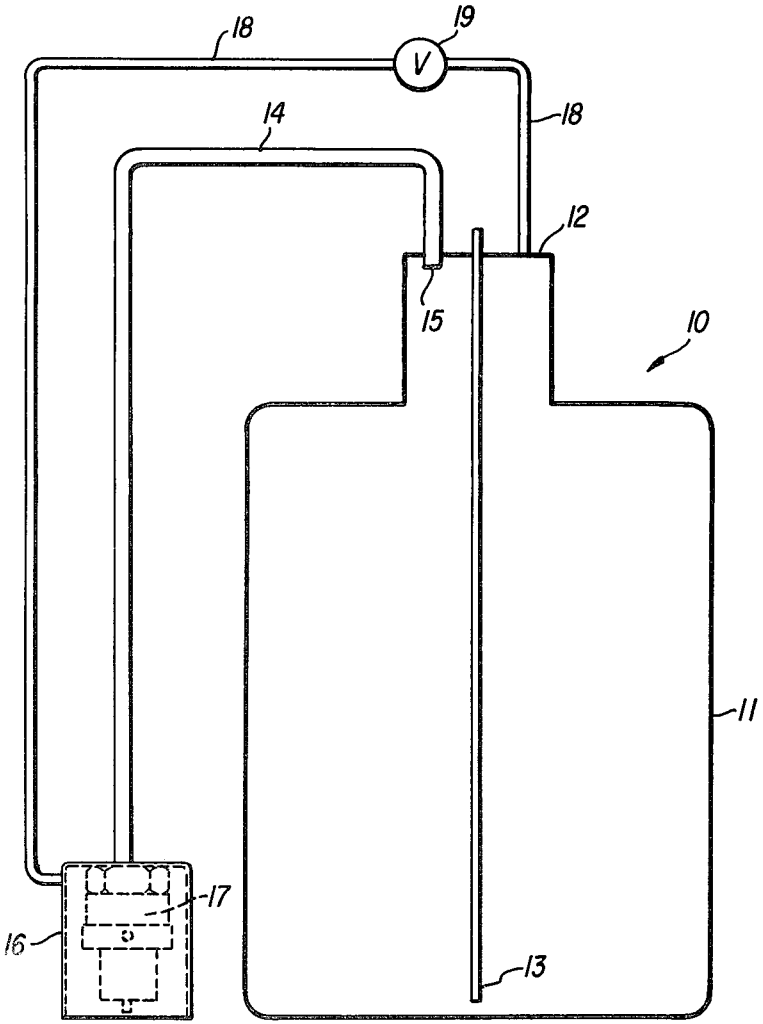
FIG. 1 is a semi-schematic view of a portable liquid oxygen container equipped to prevent freezing of the coupling during filling.

The invention will be described in greater detail with reference to the drawing. Referring now to FIG. 1 there is shown schematically portions of a portable liquid oxygen therapy unit 10. The unit includes a cryogenic liquid storage and dispensing container 11 of double walled and vacuum insulated construction. Closure means 12 are provided at the top of the container through which pass a number of conduits communicating with the interior of container 11. One of these conduits is liquid withdrawal tube 13 which extends within container 11 to a point adjacent the bottom thereof and passes liquid oxygen at a controlled rate to a vaporization coil (not shown) for breathing by a user.

A second tube 14 is provided to fill the container with liquid oxygen. One end of tube 14 passes through closure 12 and extends downwardly a short distance into container 11 terminating with open tube end 15. The other end of tube 14 passes through the base of shield means 16 (shown in greater detail in FIG. 2) and terminates in coupling means 17 shown in dashed outline.

A third conduit 18 extends from a top, normally vapor-filled point within container 11, through valve 19, and thence to the interior of shield means 16 at a point adjacent its base. Valve 19 is normally closed, being opened only during filling of the container.

Figure 2:
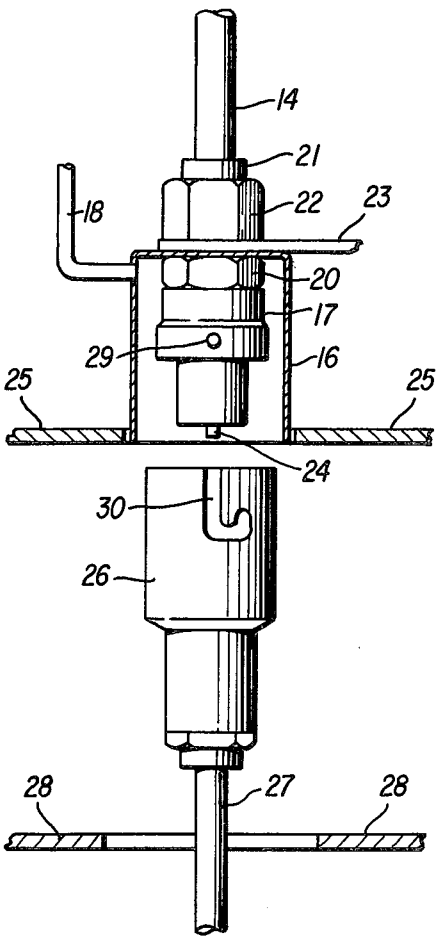
FIG. 2 is a partial sectional view of a quick connect coupling with means to prevent icing thereon during cryogenic service.

Referring now to FIG. 2, there is shown a quick connect coupling of the type commonly used to connect liquid oxygen containers for the filling of one from the other including the means of this invention for preventing icing during liquid oxygen flow. The icing prevention means comprises shield means 16 which preferably is of cylindrical cup shape open at one end. Disposed within the secured as by threadable engagement with terminal nut 20 adjacent the base of shield means 16 is a mating half, preferably the male portion, of a quick connect coupling 17.

Conduit 14, extending from the interior of container 11, is secured as by welding to terminal nut 20 and includes adjacent nut 20 a threaded boss 21. Nut 22 engages threaded boss 21 to secure shield means 16 in an encompassing position about coupling portion 17 and likewise secures the entire assembly to structural bracket 23. Conduit 18 communicates between valve 19 (FIG. 1) and the interior of shield means 16 at a point remote from the open end thereof adjacent the shield base.

The male half 17 of the quick connect coupling terminates in an outwardly extending poppet valve stem 24. It is preferred that shield means 16 extend at least to a plane even with the end of stem 24 and more preferably to a point slightly beyond that plane. Valve stem 24 is spring loaded and depression of the stem will release the contents of container 11 (FIG. 1). By extending shield means 16 to a point even with or beyond the end plane of stem 24, chances for the accidental opening of the valve are reduced. It is also preferred that the open end of shield means 16 terminate at a point approximately parallel to, or slightly above, the exterior bottom wall 25 of the shroud or case enclosing the liquid oxygen unit.

The other mating half, preferably the female portion 26, of the quick connect coupling is threadably connected to tubulation means 27. Tube means 27 extends to a normally liquid-filled portion of a storage container. The female coupling half 26 is preferably vertically disposed at the top of the storage container at a level above the container shroud 28. While other arrangements are possible, it is preferred that the male coupling half 17 be disposed in the base or bottom of the portable oxygen unit. This arrangement allows refilling of the portable unit by aligning the couplings and pressing the portable units downwardly onto the storage container.

After aligning the couplings and inserting the male coupling half into the female coupling, the units are secured in a locked and valve-open posture by rotating the portable unit through approximately 30° of arc. The male coupling half is provided with a pair of outwardly extending pins 29 which mesh with channel-like downwardly extending and sidewardly curving cam ways 30 carried by the female coupling half. As shown in FIG. 2, it is preferred that cam ways 30 be formed to require counter clockwise rotation of the portable unit for locking. This arrangement is a safety precaution as a user is likely to apply greater rotational force in the disconnecting of the two containers than in their connecting. Clockwise rotation of the portable container to disconnect it tends to tighten the threaded connection of the coupling halves to their tubulation means.

When the portable unit and storage container are secured together in a locked and valve-open posture, there is established open communication between the interiors of the two containers. Normally there will be no flow of liquid oxygen between the two containers because the pressure within the portable container is, or quickly becomes, equal to that of the storage container. Liquid oxygen flow is established by opening valve 19 which vents gas from the top of the portable unit and reduces the pressure therein. because the vented gas is obtained by vaporization of a cryogenic liquid, it is perfectly dry and carries no moisture which would condense on cold metal parts. Thus, by conducting the vent gas to the interior of shield means 16, condensation and freezing of ice on the quick connect coupling is prevented.

Fill time of a portable liquid oxygen unit is typically several minutes. During filling, the unit makes an obvious hissing noise. This noise changes when the unit reaches the full state and liquid oxygen begins issuing from the vent like. At this point, vent valve 19 is returned to its normally closed position and the portable unit is disengaged from the storage container by rotating the unit and lifting it from its mating connection through the quick connect coupling.

Although the principal advantage of this invention is in the prevention of icing on the quick connect coupling, other significant advantages also accrue. Ordinarily, gas vented from the portable container during filling is released within the container housing or shroud. This arrangement prevents the spattering of liquid oxygen on the user at the culmination of the filling procedure when liquid is issuing from the vent. The container housing or shroud is typically fabricated of plastic. Impingment of liquid oxygen on the interior surface of the portable unit housing and on the exterior shroud surface of the supply container tends to embrittle and crack the plastic. By directing the vent to the interior of the shield means 16, all contact of liquid oxygen with plastic parts, with its attendant damage, is avoided.

The shield means also acts to provide a guide for insertion of the one coupling half within the other during the mating or coupling operation. This guiding effect of the shield means can be enhanced by providing a slight outward flare to the open end of the cup like shield. The coupling is also maintained in a centered and aligned altitude within the access port of the container shroud by the shield.

While the cup like shield of this invention can be associated with either the male or female coupling portion, it is preferred that it be associated with the male coupling end. As shown in FIG. 2, the male coupling and terminates in an outwardly extending poppet tip seal which is more susceptible to mechanical damage, contamination and inadvertent activation or opening than is the female coupling end.

In another embodiment of this invention, the cup like shield means can be employed around one or the other coupling portions without connection to the source of purge gas from the container being filled. The shield means alone, without purge, significantly reduces the circulation of ambient air around and across the coupling and reduces the condensation and freezing of moisture thereon. It is commonplace for quick connect couplings to leak a bit and the leakage rate increases with wear. In these circumstances cold, dry gas leaking from the coupling acts as a purge gas supply to maintain the coupling ice free.

The invention has been described specifically in relation to its use with a portable, liquid oxygen therapy unit. However, its use is not so limited. It also finds use in the transfer of any cryogenic liquid, such as liquid nitrogen, liquid argon, Freons and the like from the container to another. Different sizes and configurations of the shield device may be employed without departing from the scope of this invention as defined in the following claims.

I claim:

1. Means for preventing freezing of atmospheric moisture on a coupling during the transfer of a cryogenic liquid from a storage container to an other container comprising:

tubulation means extending from a liquid-filled portion of said storage container to a point external to said storage container and terminating in a first coupling means;

tubulation means extending from the interior of said other container to a point external to said other container and terminating in a second coupling means, said first and second coupling means adapted to matingly connect and allow passage of liquid there through;

shield means encircling said second coupling means, said shield means conforming in shape to said first coupling means and having a opening sized to allow entry of said first coupling means for mating connection to said second coupling means and to allow venting of gas from the interior of said shield means to the atmosphere; and conduit means communicating between a normally vapor-filled portion of said other container and the interior of said shield means at a point remote from said opening.

2. The means of claim 1 wherein said shield means comprise an open-ended cylindrical cup having an internal diameter slightly larger than that of either said first or second coupling means.

3. The means of claim 2 wherein said first and second coupling means comprise a male end and a female end of a quick connect coupling.

4. The means of claim 1 wherein said first coupling means comprises the female end of said quick connect coupling and said second coupling means comprises the male end of said quick connect coupling.

5. The means of claim 4 wherein said cryogenic liquid is liquid oxygen and wherein said other container is a portable, liquid oxygen therapy unit.

6. The means of claim 5 wherein said storage container is a stationary home oxygen therapy unit.

7. The means of claim 5 wherein the open end of said cup shield is downwardly pointing relative to the normal attitude of said portable, liquid oxygen therapy unit and is accessable through a port in a shroud enclosing said unit.

8. The means of claim 7 wherein the open end of said cup shield lies in the approximate plane of the exterior bottom wall of said shroud.

9. The means of claim 4 wherein said vapor conduit means enters said cup shield at the side adjacent the cup base.

10. The means of claim 4 wherein the open end of said cup shield is flared outwardly to guide insertion of the female end of said coupling.

11. The means of claim 4 wherein the open end of said cup shield extends to a plane at least even with the tip of said male coupling end.

12. The means of claim 4 wherein said quick connect coupling is lockable in a valve-open posture by counter clockwise rotation of said male fitting end.

13. The means of claim 1 including valve means controlling flow through said conduit means.

14. A method for preventing freezing of atmospheric moisture on a quick connect coupling of the type having a male end and a female and during the filling of a first container with a cryogenic liquid from a second container comprising:

inserting the male coupling end into the female coupling end and locking the coupling in a valve-open posture to thereby establish fluid communication between the interiors of the two containers;

venting gas from the top interior of said first container to reduce the pressure in said first container below that in said second container and to thereby induce liquid flow from the second container and through the coupling into the first container;

directing said vented gas around and along the length of said coupling and thence to the atmosphere; and shielding said vented gas from admixture with the atmosphere while in contact with said coupling and while liquid is flowing through said coupling.

15. The process of claim 14 wherein said cryogenic liquid is liquid oxygen.

16. The process of claim 15 wherein said first container is a portable, liquid oxygen therapy unit.

17. The process of claim 16 wherein said second container is a stationary, home oxygen therapy unit.

18. The portable, refillable container for dispensing vaporized liquid oxygen comprising:

an insulated flask adapted for the containment and storage of liquid oxygen;

a first conduit means extending from a point within said flask to a point external to said flask, the external end of said first conduit means terminating in the male portion of a quick connect coupling;

a cup-shaped shield means encircling said male coupling portion, the open end of said shield means extending at least to a plane even with the end of said male coupling portion;

second conduit means communicating between a normally vapor-filled area within said flask and the interior of said shield means at a point remote from the open end thereof; and valve means controlling flow of fluid through said second conduit.

19. The container of claim 18 wherein said shield means is cylindrical in shape having a flat bottom which is essentially perpendicular to the side wall of said shield means.

20. The container of claim 19 wherein the internal diameter of said shield means is slightly larger than the external diameter of a female coupling portion matable with said male coupling portion.

21. The container of claim 20 wherein said second conduit means enters said cup-shaped shield means at the side adjacent the cup base.

22. The container of claim 21 wherein the open end of said shield means is downwardly pointing relative to the normal attitude of said container and is accessible through a port in a shroud enclosing said container.

23. The container of claim 22 wherein the open end of said shield means lies in the approximate plane of the exterior bottom of said shroud.

24. The container of claim 18 wherein the open end of said cup-shaped shield means is flared outwardly to guide insertion of a female coupling end for mating connection to said male coupling portion.

25. Means for reducing or eliminating the freezing of atmospheric moisture on a coupling during the transfer of a cryogenic liquid from a storage container to an other container comprising:

tubulation means extending from a liquid-filled portion of said storage container to a point external to said storage container and terminating in a first coupling means;

tubulation means extending from the interior of said other container to a point external to aid other container and terminating in a second coupling means, said first and second coupling means adapted to matingly connect and allow passage of liquid there through;

and shield means encircling one or the other of said first and second coupling means, said shield means conforming in shape to, and having an opening slightly greater than, the larger of said first and second coupling means to allow mating connection of said first coupling means to said second coupling means and to allow venting of gas from the interior of said shield means to the atmosphere.

26. The means of claim 25 wherein said shield means comprise an open-ended cylindrical cup having an internal diameter slightly larger than that of either said first or second coupling means.

27. The means of claim 26 wherein said first and second coupling means comprise a male end and a female end of a quick connect coupling.

28. The means of claim 27 wherein said cup shield encircles the male end of said coupling and wherein the open end of said shield extends to a plane at least even with the tip of said male coupling end.

* * * * *

UNITED STATES PATENT AND TRADEMARK OFFICE

CERTIFICATE OF CORRECTION

PATENT NO. : 4,462,223

DATED : July 31, 1984

INVENTOR(S) : Warren E. Perkins

It is certified that error appears in the above—identified patent and that said Letters Patent is hereby corrected as shown below:

In claim 14, line 3; "and" (second occurrence) should be --end--.

In claim 18, line 1; "The" should be --A--.

Signed and Sealed this

*Fifth* Day of *March 1985*

[SEAL]

*Attest:*

DONALD J. QUIGG

*Attesting Officer* *Acting Commissioner of Patents and Trademarks*